United States Patent [19]

Eckhaus

[11] Patent Number: 4,806,711

[45] Date of Patent: Feb. 21, 1989

[54] DOOR JAMB BUTTON

[76] Inventor: Ira Eckhaus, 3221 Skillman Ave., Oceanside, N.Y. 11572

[21] Appl. No.: 195,716

[22] Filed: May 18, 1988

[51] Int. Cl.[4] ..... H01H 3/16

[52] U.S. Cl. ..... 200/61.62; 439/395

[58] Field of Search ..... 200/61.62, 243, 254, 200/279, 247, 163, 159 R, DIG. 25; 439/395

[56] References Cited

U.S. PATENT DOCUMENTS 4,274,198 6/1981 Bouley ..... 439/395

4,274,696 6/1981 Long et al. ..... 439/395

4,283,107 8/1981 Anthony ..... 439/395

4,609,910 9/1986 Geringer et al. ..... 200/61.62

*Primary Examiner*—Roy N. Envall, Jr.

*Attorney, Agent, or Firm*—Helfgott & Karas

[57] ABSTRACT

A switch with a body structure for mounting on the face of a support with actuation perpendicular to the support. Electrical wires are inserted through the sides of the body into guides that splice the wires, retain them and guide them while being moved by the actuator into the spliced position. The wires are then retained during operation of the actuator which bridges the wires to connect them.

17 Claims, 2 Drawing Sheets

DOOR JAMB BUTTON

The invention is directed to electrical switches and, in particular, a burglar alarm door jamb button, wherein the structure operates to splice the wires and retain them for subsequent electrical interconnecting therebetween.

BACKGROUND

Switches have been in use for some time where the switch is mounted and wired at some time subsequent to the construction of the item in which the switch is mounted. For example, in the jamb of a door in which it is desired for security reasons to be able to determine whether the door is open or closed or for illumination reasons to turn on a light when the door is open, and to turn it off when the door closed. Frequently, construction takes place at one point in time and the desire for a switch which either interrupts or produces continuity in a circuit, comes at a point later in time.

By way of example, in installing a burglar alarm system a number of door jamb switches must be installed. It is of advantage to be able to connect these switches into the current quickly and without excessive time consumption. It is also important that these switches will operate reliably and efficiently during opening and closing of the door.

Most such door jamb switches require the connection of wires to contacts through the use of screws or soldered contacts. Such connections are time consuming and are not very reliable. The major problem is that the wires must be stripped in order to make such contact.

SUMMARY OF INVENTION

The switch of the invention includes a body structure into which the wiring members are inserted that both positions the wires and makes contact thereto without removal of the insulation. The body structure provides for mounting in as well as supporting onto the face of a supporting member. Within the body are guides that retain the inserted wires and guide them, under force applied by a spring loaded actuator moving perpendicularly to the supporting member, to an actuation location at which location the face of the actuator causes the guides to splice the insulation. The actuator also provides electrical continuity between the wires.

DESCRIPTION OF INVENTION

In order to illustrate the advantages of the structural features of the invention, a description of an application of a switch in the conditions of a door jamb is set forth in connection with FIG. 1.

Figure 1:
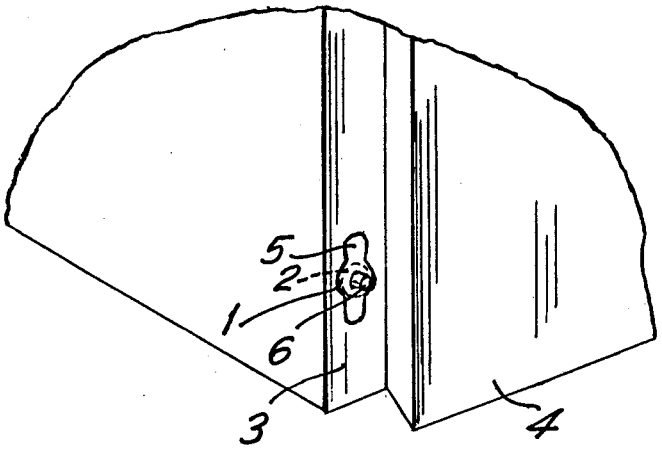
FIG. 1 is a perspective view illustrating the switch of the invention in position in a door jamb.

Referring to FIG. 1, there is shown a perspective sketch of the switch of the invention located in an application where the switch is positioned from one side of a supporting member in which an opening for the switch is provided. In the sketch of FIG. 1, the switch 1 of the invention is positioned in an opening 2 in a supporting member 3 which would be the jamb against which a movable member 4 such as a door would close.

The switch of the invention is provided with electrical wire retention capability so that wires without removal of their insulation are positioned in the switch 1 and the switch is then inserted into the jamb 3 opening 2 being retained there by shoulder structure 5. When the actuator 6 is depressed the wires are moved into place and cut through their insulation. The wires are then interconnected with a circuit, such as a burglar alarm system. When the door is closed, it retains the actuator depressed and the wires are electrically interconnected by the actuator. When the door is opened, as for example, in a break-in, the actuator is released thereby breaking the contact between the wires, opening the circuit and sounding an alarm.

In a usual situation such as that illustrated, electrical wiring at the opening in the supporting structure must have the insulation removed through stripping the ends of the wires and then each wire must be attached to a switch terminal with both reliable and good electrical contact. Typically, they are soldered or connected through screws. It will be apparent that these operations must be performed in a confined space, and they require time and frequently introduce opportunity for error. With the switch of the present invention the wires are merely inserted in the switch and the actuator is depressed before mounting the switch to guide the wires and cut through the insulation. The switch is then inserted into the opening and fastened. Capabilities built into the switch structure perform all other operations.

Figure 2:
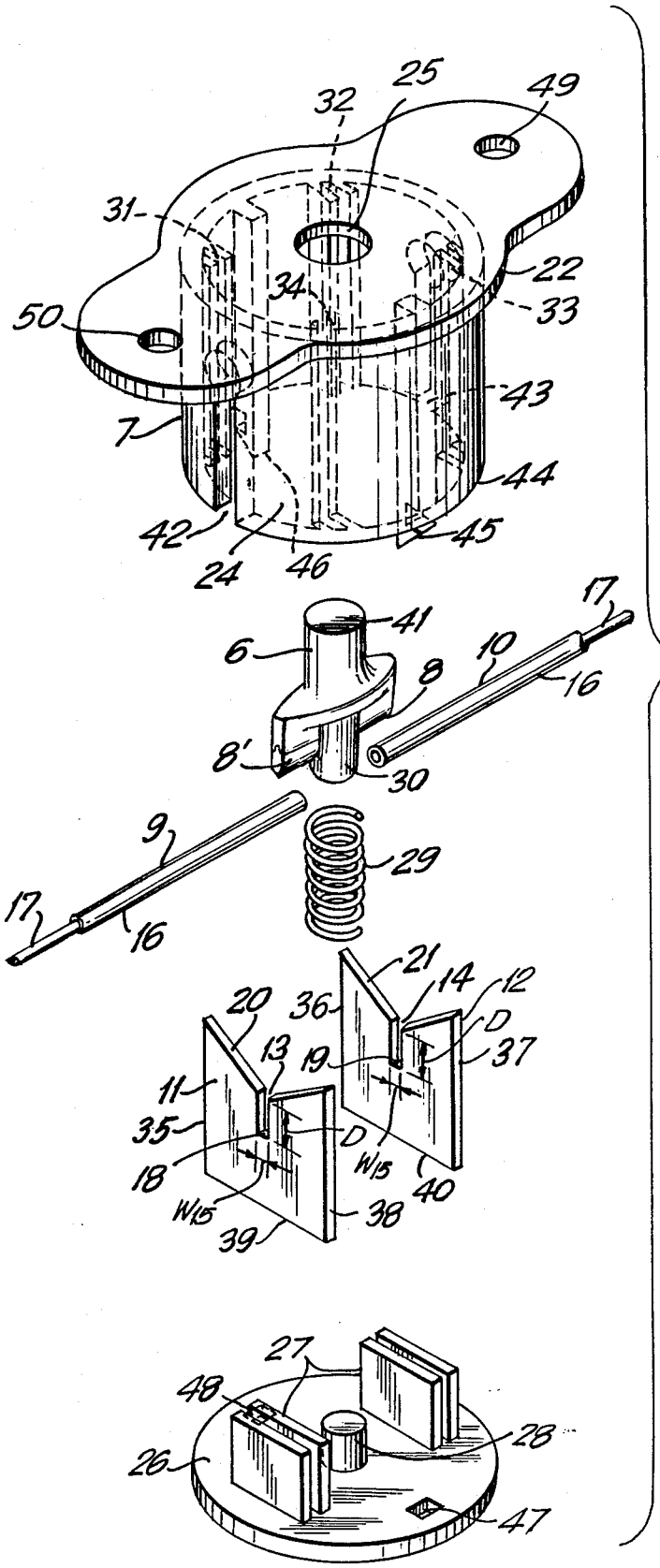
FIG. 2 is an exploded perspective view of the parts of the switch of the invention and the electrical wires to be connected thereto.

The structure of the switch of the invention is illustrated in the exploded sketch of FIG. 2, which shows the functional elements of the switch and wires with the individual elements separated.

Referring to FIG. 2, the switch has a supporting housing 7 within which an actuator 6 with a contacting and insulation severing inducing portion or edge s is moved against the insulated ends 9 and ID of the electrical wires that are supported and retained both laterally and vertically by wire support members 11 and 12. These wire support members 11 and 12 also serve as blade members. These members have slots 13 and 14 Which grip the wires 9 and 10 by being smaller in width (W) 15 than the diameter of the insulation 16 of the wires, and of the order of the width of the conductor 17 of the wires 9 and 10. The wires 9 and 10 are ultimately supported at a contact location at the bottoms 18, 19 of the slots 13 and 14. The bottoms 18 and 19 of the slots 13 and 14 are positioned at a depth (D) selected so that the inducing portion or edge s of the actuator 6 when the actuator 6 is in a position at the end of its depressed travel, is in slots 13 and 14 of blade members 11 and 12 respectively, and is in contact With and providing continuity between the conductor portions 17 of the wires 9 and 10. The upper portions 20 and 21 Of the blades 11 and 12 serve to guide and position the wires 9 and 10 and can serve as a stop for the actuator.

The switch of the invention has a supporting portion 22 with a shoulder that interfaces with the jamb or other support 3 of FIG. 1 and has a switch mechanism containing body 24. The actuator opening in the member 22 is labelled element 25.

The structure of the switch of the invention further has a back closure portion 26 having supports 27 for the wire supporting members 11 and 12 and a retaining knob 28 for entry into one end of a spring member 29, the other retaining knob for the spring 29 being a leg 30 depending from the actuator 6. Leg 30 can be integral with the actuator 6 or formed as a separate piece. The housing 7 is equipped with guiding and supporting members 31–34 shown as tracks on the inside of the housing 7 which support the edges 35–38 of the blade members 11 and 12 the lower edges 39 & 40 of which are positioned in supports 27.

The invention has advantages when the wiring assembly operation takes place. The wires 9 and 10 can be brought out through the opening 2 of the door jamb or other support shown in FIG. 1, and positioned in the slots 13 and 14 in the wiring supporting members 11 and 12, which in turn are held by the supports 27 on each side of the line of travel through the opening 25 and essentially perpendicular to the back enclosure portion 26. The spring 29 is positioned with one end over the retaining knob 28 and with the leg 30 of the actuator 6 in the other end. The housing 7 is positioned with the edges 35–38 in the slots 31–34 respectively and the striker or force receiving portion 41 of the actuator 6 in line with and through the opening 25. The wires 9 and 10 are inserted into the enlarged mouths of the slits 42 and 43 respectively. When edge 44 of housing 7 is in contact with the back closure portion 26 latches 45 and 46 extend through openings 47 and 48 of the back closure portion and retain the assembly closed. The assembly is placed in the opening 2 of FIG. 1 and retained by elements such as screws (not shown) inserted through holes 49 and 50.

Figure 3:
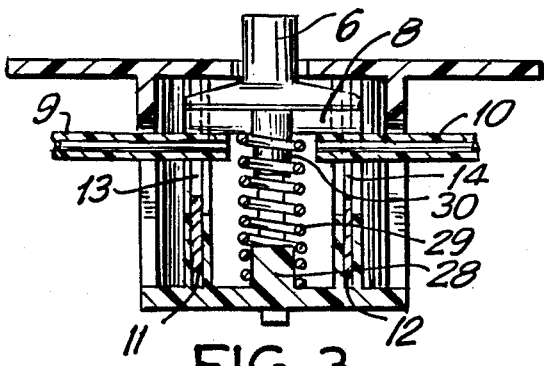
FIGS. 3, 4, and 5 are cross sectional views of the switch in assembled condition illustrating the operations of positioning and contacting the electrical wires.

Referring next to FIGS. 3, 4, 5, and 6, in which the details of the contacting operation illustrated in FIG. 2 are shown in various stages of operation. In FIG. 3, the actuator 6 with a contacting edge member 8 is shown in a position in the assembly wherein the wires 9 and 10 have just been positioned in the mouths of slots 13 and 14 of the blades 11 and 12 through the enlarged mouths of slits 42 and 43. The spring 29 centered around the leg 30 on the actuator 6 and the retaining knob 28 at the bottom of back enclosure portion 26 hold the assembly in position with the actuator 6 extended.

Figure 4:
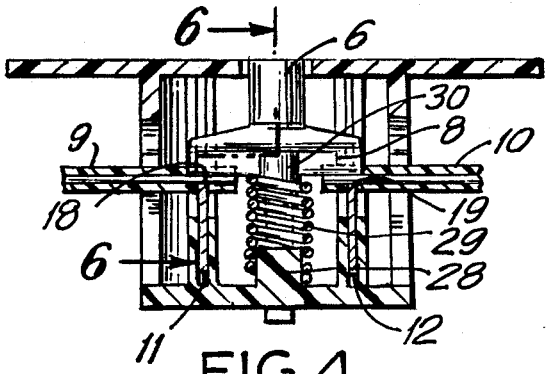

Referring next to FIG. 4, in this illustration the actuator 6 depressed to push the wires 9 and 10 down into the slots 13 and 14 contacting location positions 18 and 19 in the wire supporting members 11 and 12 s the wires move downwardly, the sharp sides of the slots 13 and 14 splice through the insulation to make contact with the metal core of the wire. The supporting members 11 and 12 are of conducting material. As the actuator is depressed, the spring is compressed.

Figure 5:
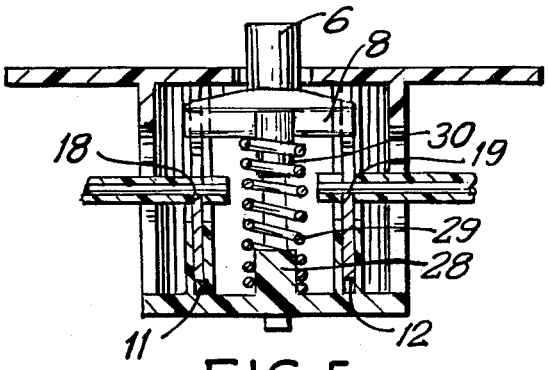

Referring next to FIG. 5, the actuator in this illustration, after having pushed the wires into the position of FIG. 4 is released and the wires are now in connected position for use. In its normal use as a burglar alarm switch, the actuator will be depressed by the door being closed. In that case, the actuator edge 8, which is of conductive material will contact the supporting members 11 and 12 and complete the circuit. If the door opens, the spring biases the actuator into its extended position to open the circuit and sound an alarm.

It should be understood that the switch could also be used so that in its normal position the actuator is extended, upon force such as a door closing, the actuator is depressed so the conductive edge portion s will bridge the intersection between the wires and close the circuit.

Figure 6:
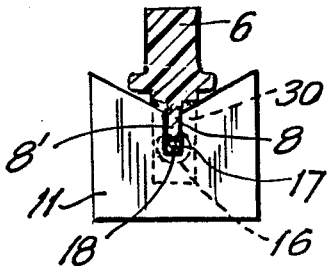
FIG. 6 is a cross sectional view taken along lines 6—6 of FIG. 4 and showing detail of the electrical wire contacting capability.

Referring next to FIG. 6, which is a view taken along the lines 6—6 of FIG. 4, the actuator 6 is shown depressed down into the slot in the blades, where the edge 8 makes contact with the blade 11 and conductor 17 in the wire. Although the entire actuator 6 could be made of conductive material, it is possible that the actuator be of insulating material and just the edge s is of conductive material. By way of example, a metal band 8, could be formed on the end of the actuator.

In operation the switch of the invention is positioned with the retaining shoulder of the supporting member 22 against the jamb or other support 3 of FIG. 1, with the switch mechanism containing body 24 of the housing 7 in the opening 2 of FIG. 1. The wires 9 and 10 pass into the switch through the enlarged mouths of slits 42 and 43. The back 26 has been latched 45–48 in place. The wires 9 and lo are seated at the bottom of the supporting members 11 and 12.

It Will be apparent to one skilled in the art that there will be many variations within the principle of the invention. It being important only that the mechanism be such that the wires are retained and guided so that the actuator can press the wires 9 and 10 down into the slots which sever the insulation on the wires in the first operation and thereafter on subsequent operations make or break contact between them.

What has been described is a quick-connect doorjamb switch in which the wires without being required to be stripped of insulation can be placed in position in the switch. Through the first operation of the switch contact is made and, thereafter, the switch is connected for normal operational use.

What is claimed:

1. In a switch of the type wherein an actuator element is moved to modify electrical continuity between at least two insulated wires the improvement comprising in combination:

at least first and second wire supporting members adapted to guide said wires to a retaining slot therein, grip said wires in said slot wherein said slot has a width dimension less than the diameter dimension of the insulation of said wires to thereby splice the wire, and support said wires in insulation severing and contacting operations, and an electrical bridging portion on said actuator element adapted for both inducing splicing of the wire and contacting the wires, and having a dimension to permit insertion into said slots.

2. The switch of claim 1 including a switch mechanism retaining housing having wire accommodating slots.

3. The switch of claim 2 wherein said housing has a switch supporting member with an opening for at least a portion of the actuator on one side and a backing member on the other side.

4. The switch of claim 3 where said wire supporting members are retained in supports in said backing member and in guides in said housing.

5. The switch of claim 4 wherein said actuator is of a material that has lower electrical conductively than said bridging portion.

6. A switch comprising in combination:

a housing, said housing having a relatively planar face portion with means for retention against the face of a supporting member to which said switch is to be attached; said housing further having a body portion essentially perpendicular to said face portion and adapted for providing switch mechanism travel direction, and limits and insertion capability for at least two electrical wires, each wire having a conductor diameter and an insulation diameter;

an actuator member, said actuator member having a first force receiving portion extending through an opening in said face portion of said housing positioned essentially centrally of said body portion; said actuator member further having a bridging portion narrower than said insulation diameter of said wires and adapted for forcing down the wires and making electrical contact thereto;

spring means biasing said actuator at one said travel limit, first and second wire support members, said wire support members being positioned in said body parallel to said travel direction with one wire support member on each side of said opening in said face portion; said wire support members being separated a distance less than said bridging portion of said actuator; said wire support members each having on a side thereof adjacent said face portion of said housing a guiding region from the edge thereof to a central wire retaining and contacting location slot, each said slot having a width and depth dimension, said width dimension being less than said insulation diameter of said wires; and said wire support members being rigidly positioned in said body at a location with respect to said travel limits such that said depth dimension position of said slot operates to enable bridging electrical contact between said second portion of said actuator and each said wire.

7. The switch of claim 6 wherein said housing body portion includes wire accommodating slots.

8. The switch of claim 7 wherein said housing body includes a backing member on the side opposite said face portion.

9. The switch of claim 8 wherein said wire support members are retained in supports in said backing member and in grooves in said housing body.

10. The switch of claim 9 wherein said bridging portion of said actuator has a higher electrical conductivity than the remaining portion of said actuator.

11. A quick connect door jamb button switch for interconnecting at least two insulated wires, comprising:

a housing, a pair of spaced apart wire supporting means in said housing, each wire supporting means having a slot therein, cutting edges defined on sides of each slot, the width of each slot being such as to cause the cutting edges to splice a wire pushed into the slot, an actuator button movably supported on said housing and having an edge portion insertable into both said slots, whereby with wires placed into each said slot, a first depression of said button pushes the wires into the slots to splice the wires which then contact the supporting means, and subsequent depressions of said button conductively interconnecting the wires.

12. A switch as in claim 11, and further comprising biasing means associated with said actuator for normally biasing said actuator in a con-depressed position.

13. A switch as in claim 11, wherein said actuator is of non-conducting material, and further comprising a band of conducting material on said edge portion.

14. A switch as in claim 11, wherein said housing comprises elongated slits aligned with said slits, whereby the wires can be inserted into said slits externally of said housing and pushed down into the slits.

15. A switch as in claim 11, wherein the actuator button comprises a portion which projects from the housing.

16. A switch as in claim 13, wherein said conducting material is in the form of a band.

17. A switch as in claim 11, wherein said housing comprises a casing portion and a base portion and further comprising latching means extending from said casing portion and openings in said base portion for receiving said latching means.

* * * * *